United States Patent [19]

Vetrov et al.

[11] 4,080,697

[45] Mar. 28, 1978

[54] ARRANGEMENT FOR INSTALLATION OF RIBBON-TYPE ENCLOSING STRUCTURE

[76] Inventors: Boris Danilovich Vetrov, ulitsa Chaikovskogo, 56, kv. 8, Leningrad; Boris Eliseevich Kiselev, Volgogradsky prospekt, 137, korpus 1, kv. 91, Moscow; Vladimir Ivanovich Kostjukovich, ulitsa Sofiiskaya, 31, kv. 149, Leningrad; Leonid Nikolaevich Mikhailovsky, ulitsa Novo-Alexandrovskaya, 21, kv. 1, Leningrad; Julia Nikitichna Ryabikova, ulitsa Sedova, 52, kv. 1, Leningrad; Viktor Ivanovich Trofimov, ulitsa Zoologicheskaya, 30, kv. 68, Moscow, all of U.S.S.R.

[21] Appl. No.: 711,519

[22] Filed: Aug. 4, 1976

[51] Int. Cl.[2] ..... B21B 15/00; B23P 23/04; B23P 25/00

[52] U.S. Cl. ..... 29/33 K; 29/509; 29/819; 29/243.58; 29/564.1

[58] Field of Search ..... 29/243.5, 819, 33 K, 29/283.5, 509, 245.58, 564.1

[56] References Cited

U.S. PATENT DOCUMENTS

| | | | |
|---|---|---|---|
| 2,574,509 | 11/1951 | Stuart | 29/243.58 X |
| 3,081,537 | 3/1963 | Nony et al. | 29/509 |
| 3,191,283 | 6/1965 | Cain | 29/243.5 |
| 3,346,941 | 10/1967 | Patry et al. | 29/509 X |
| 3,503,111 | 3/1970 | Janecek | 29/243.58 |
| 3,609,845 | 10/1971 | Taylor | 29/243.5 |
| 3,875,642 | 4/1975 | Knudson | 29/243.5 |

*Primary Examiner*—Charlie T. Moon

*Attorney, Agent, or Firm*—Robert E. Burns; Emmanuel J. Lobato; Bruce L. Adams

[57] ABSTRACT

The invention comprises bending longitudinal edges of coiled ribbons toward the board elements of girders and drawing the ribbons over these elements with subsequent fixing of bent edges thereto. Then the ribbons are tensioned lengthwise, and the bent edges are crimped around the board elements of the girders.

The arrangement for effecting this method of installation comprises a coiled ribbon mounted in an uncoiling means a bending mechanism for shaping the ribbon to obtain a profile corresponding to the board elements of the girders, and means for crimping the bent edges of the ribbon. The bending mechanism receiving the ribbon from the coil comprises a rigid frame disposed beneath the ribbon drawn between two adjacent girders which are rigidly connected to a pair of bilaterally symmetrical bending heads mounted to both end faces of the frame. Means for crimping the bent edges of the ribbon comprises a housing having a crimping head, the housing being connected to both ends of a cross-piece movably mounted to the girder. One of the ends of the cross-piece is articulated to the housing and the other end is connected to the housing by means of a clamping member.

5 Claims, 11 Drawing Figures

ARRANGEMENT FOR INSTALLATION OF RIBBON-TYPE ENCLOSING STRUCTURE

The invention relates to the construction industry, and more particularly to a method and arrangement for installation of ribbon-type enclosing structures. The invention may be widely used in the construction of industrial buildings and in civil engineering for installation of walls, ceilings and roofing.

In constructing general-purpose buildings, and especially industrial buildings, the installation operations are of primary importance in the construction technique. The level of mechanization of installation operations at the building site is vital for labour productivity, construction costs and labour conditions. These figures largely depend on how the problem of mechanization of installation operations is solved. Successful solution of this problem enables material reduction of costruction time and cost.

Two types of enclosing structures are used in the building industry: panel and ribbon-type structures. Recently the enclosing structures of coiled ribbons are coming into a widespread use because they permit threefold reduction of metal consumption per 1 $m^2$ of ceiling surface and twofold cost reduction per 1 $m^2$ of enclosure; besides, they are easily transported which is very important for construction operations in remote areas.

Installation of ribbon-type enclosing structures may be effected in different ways. In particular, one known method of installation of enclosing structures, such as of suspended ceilings consists in lifting and end of a coiled aluminium ribbon mounted in an uncoiling means up to a design altitute (19–20 m), placing it around a guide roller, directing to the board elements of girders and drawing thereover to extend along the entire length of the building. Concurrently with the drawing operation, the surfaces of the board elements of the girders and ribbon edges are degreased to provide for an appropriate quality of spot welding. To prevent the ribbon from sliding off the board elements of the girders, temporary support bars are mounted therebetween at 3 m spacing. Tensioning means are secured to the ends of the ribbon extending along the entire length of the building, and the tensioning means are used to tension the ribbon to a stress of 100 to 150 kg/$cm^2$. Then the support bars are removed, and the ribbon is fixed to the boards of the girders by argonarc spot welding.

The above-described fastening of the ribbon to a girder exhibits an important disadvantage. As a result of local stress concentration appearing at the weld spots due to the metal heating the ribbon is deformed thus unsealing the joints and deteriorating the external appearance of the structure.

At present the installation of suspended ceiling is effected in accordance with the above-described technique with the only difference that the ribbon is fastened to the board elements of the girders by riveting. This method of fastening allowed to eliminate partially the above disadvantages.

It should be, however noted that this method also has a number of material disadvantages, and namely:

(a) installation and subsequent removal of support bars for fixing the ribbon to the board elements of girders;

(b) drilling holes for rivets in inconvenient position and at high altitude (19–20 m);

(c) insertion of rivets;

(d) riveting while supporting the ribbon from beneath at an altitude and in the position in which the operator holding a riveting hammer and the operator holding a riveting dolly are separated by the ribbon web.

Repeated shutter movements during the accomplishment of all operations along the entire length of the building (passage along the building during the drawing and installation of bars, removal of the bars after the ribbon tensioning, drilling for rivets, riveting) require four passes per ribbon.

A large number of effort-consuming manual operations in combination with an elevated danger of works do not permit the installation to be comprehensively mechanized. Therefore, the methods of installation of ribbon-type enclosing structures known heretofore have a number of disadvantages which restrict their application.

Known in the art are various arrangements for installation of enclosing structures.

One arrangement of this type is disclosed in French patent No. 2105153, Cl. E 04 f. The arrangement is designed for interconnection of metal members by machining the mutually engaging surfaces by means of a roller working member.

The housing of the arrangement is inserted into a profiled element which is preliminarily installed in a girder and is fixed therein, whereafter a lever of a roller working member is rotated to expand the profiled member so as to ensure its rigid locking within the girder.

It should be noted that this arrangement does not enable mechanization of fastening profiled members to a girder. In addition, the use of this arrangement for installation of enclosing structures would not permit the production process to be intensified.

Known in the art is an arrangement for erection of silo bodies out of coiled ribbon comprising a coiled ribbon mounting in an uncoiling means which is fed to a bending mechanism for folding the ribbon, and means for crimping the folded edges of the ribbon.

However, this arrangement is stationary and cannot be operated at an altitude of 19–20 m and higher which is characteristic of operations associated with installation of enclosing structures. Moreover, means for crimping the ribbon edges is not movable so that the use of this means is limited. The arrangement cannot ensure the accomplishment of all operations of installations of ribbon-type enclosing structures.

The main object of the invention is to improve the method of installation of ribbon-type enclosing structures for automating the fastening of the ribbon to the board elements of girders and to provide an arrangement for effecting the method.

Another object of the invention is to reduce manual labour for installation.

Still another object of the invention is to reduce installation time and to ensure safety of labour conditions.

These and other objects are accomplished by that in a method of installation of ribbon-type enclosing structures comprising drawing coiled ribbons over the board elements of girders with concurrent fixing thereof to said elements, tensioning the ribbons lengthwise and fastening them along the entire length of the girders, according to the invention, prior to the drawing of the coiled ribbons, longitudinal edges thereof are bent toward the board elements of the girders, and the bent edges of the ribbons are fixed, whereafter the ribbon edges are crimped around the board elements of the girders.

In an arrangement for installation of ribbon-type enclosing structures comprising a coiled ribbon mounted in an uncoiling means and fed to a bending mechanism for shaping the ribon to obtain a profile corresponding to the shape of the board elements of the girders, and means for crimping the bent edges of the ribbon, according to the invention, the bending mechanism comprises a rigid frame disposed beneath the ribbon drawn between two adjacent girders which are rigidly connected to bilaterally symmetrical bending heads mounted to both ends of the frame, and means for crimping the bent edges of the ribbon comprises a housing having a crimping head, the housing being connected to both ends of a cross-piece movably mounted to the girder so that one end of the housing is articulated to one end of the cross-piece and is connected to the other end thereof by means of a clamping member.

The bending head preferably comprises two spring-loaded parts accommodating at least three pairs of driven rollers, the axes of two adjacent pairs of rollers extending in parallel with one another and the axes of the third pair of rollers extending at an angle to each other.

The driven rollers of the bending head should be profiled.

The crimping head may have two pairs of driven rollers embracing the board elements of the girder, the rollers axes extending in parallel with one another.

The driven rollers of the crimping head are spring-loaded and profiled.

The invention consists in the following.

During installation of ribbon-type enclosing structures a ribbon, which is mounted in an uncoiling means, is lifted with one end thereof up to the altitude of girders and fed in the bending mechanism in which longitudinal edges of the ribbon are bent toward the board elements of the girders in such a manner that the bent edges of the ribbon should be shaped to correspond to the outer profile of the board elements of the girders.

The ribbon with the bent edges is placed onto the board elements of two adjacent girders and is supported thereon without slackening due to the bent edges.

Thus the ribbon is fixed relative to the girders.

In this position, the ribbon, which slides over the girder with the bent edges thereof, is drawn along the entire length of the building. Then tensioning means are secured to both ends of the ribbon to tension thereof.

The tensioned ribbon which is fixed to the board elements of the girders with the bent edges thereof (the structural arrangement of the board elements may vary, but in any case the girders should have round or bulbed bosses at the ends) is crimped around the board elements thus ensuring a strong and sealed fastening of the ribbon to the girders.

Due to the construction of the arrangement consisting of the bending mechanism and means for crimping the bent edges of the ribbon the edges of the ribbon can be first bent and then crimped around the board elements of the girders by using units mounted in series.

The provision of two bilaterally symmetrical bending heads in the bending mechanism which are mounted to the ends of the rigid frame arranged between two adjacent girders beneath the ribbon being drawn enables concurrent bending of both edges of the ribbon and immediate placing thereof onto the board elements of the girders, whereby the ribbon is automatically fixed to the girders.

Crimping the ribbon around the board elements of the girders determines high quality of fastening as compared to the ribbon fastening by riveting or spot welding.

Structural arrangement of means for crimping the bent edges of ribbon in the form of crimping head connected, via the housing, to both ends of the cross-piece movably mounted to the girder enables continuous crimping of the ribbon during the displacement thereof over the board elements of the girder.

The provision of the bending head consisting of two parts accommodating at least three pairs of shaped rollers which are arranged in such a manner that the axes of two adjacent pairs of rollers extend in parallel with one another and the axes of the third pair of rollers extend at an angle to each other enables the bending of longitudinal edges of the ribbon to obtain a profile corresponding to the shape of the board elements of the girders, and the opportunity of displacing the heads relative to the girders makes it possible to bring the bent edges in register with the board elements.

Due to the fact that the crimping head is provided with two pairs of profiled rollers embracing the board elements of the girder, the roller axes extending in parallel with one another, there is an opportunity of tight crimping of the bent edges of ribbon around the board element of the girder.

As the bending heads and the rollers of the crimping head are spring-loaded, both edges of the ribbon having different thickness may be bent and crimped thus enlarging the range of ribbons suitable for installation of enclosing structures.

Therefore, the method and arrangement for installation of ribbon-type structures according to the invention enable automation of labour-consuming operations of fixing and fastening the ribbon to the girders thus making possible installation time reduction, lowering the cost of operations and improving labour conditions.

Other objects and advantages of the invention will become apparent from the following detailed description of specific embodiments thereof illustrated in the accompanying drawings, in which:

FIG. 1 diagrammatically illustrates the lifting and drawing of ribbon over the board elements of girders;

Figure 1:
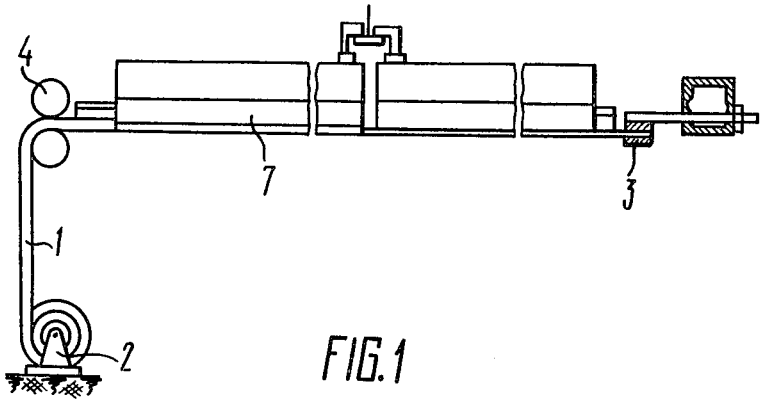
Figure 2:
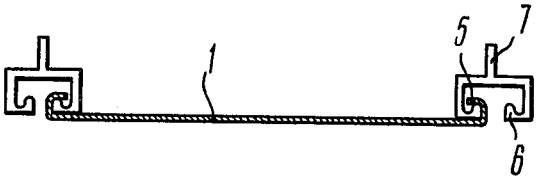
FIG. 2 shows the step of bending the ribbon edges toward the inner surface of the board elements.
Figure 3:
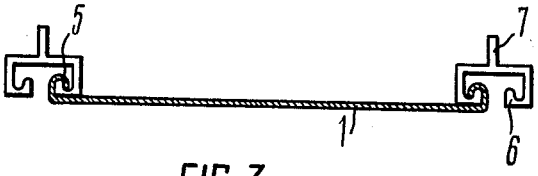
FIG. 3 shows the step of crimping the bent edges of the ribbon around the board elements of girders.

The method for installation of ribbon-type enclosing structures according to the invention uses a coiled ribbon 1 mounted in an uncoiling means 2 (FIG. 1) and lifted by means of a preliminarily secured tensioning member 3 to a bending mechanism 4 for bending longitudinal edges 5 of the ribbon 1 toward board elements 6 of the girders 7 (FIG. 2). The ribbon 1 with the bent edges 5 leaving the bending mechanism 4 is placed onto the board elements 6 of the two adjacent girders 7 to which it is fixed against slackening and sliding during the drawing over the girders along the entire length of the building. A second tensioning member identical to the first tensioning member 3 is secured to the other end of the ribbon 1 drawn along the entire length of the building, and the ribbon is tensioned. Then the bent edges 5 of the ribbon 1 are crimped around the board elements 6 of the girders 7 (FIG. 3) using a crimping means 8.

The reference is now made to a specific example of installation of a suspended ceiling using a coiled ribbon of aluminium alloy. The ribbon thickness is 1 mm. The board element 6 of the girder 7 is shaped as a round section member of 13 mm diameter. Crimping of the bent edges 5 around the board elements 6 is effected through an angle equal to 270°. The ribbon fastened in this manner withstands loads of up to 1100 kg per one meter of length. By conventional method using rivets for fastening the ribbon to the girders, maximum loads applied to the rivet fasteners were up to 700 kg.

Therefore, the comparison of physical and mechanical properties of the ribbon-type enclosure shows that the strength of fastening in accordance with the method of the invention is 1.5 times greater.

The above-described example illustrates high strength of fastening of the ribbon to the girder and efficiency of the method according to the invention.

Figure 6:
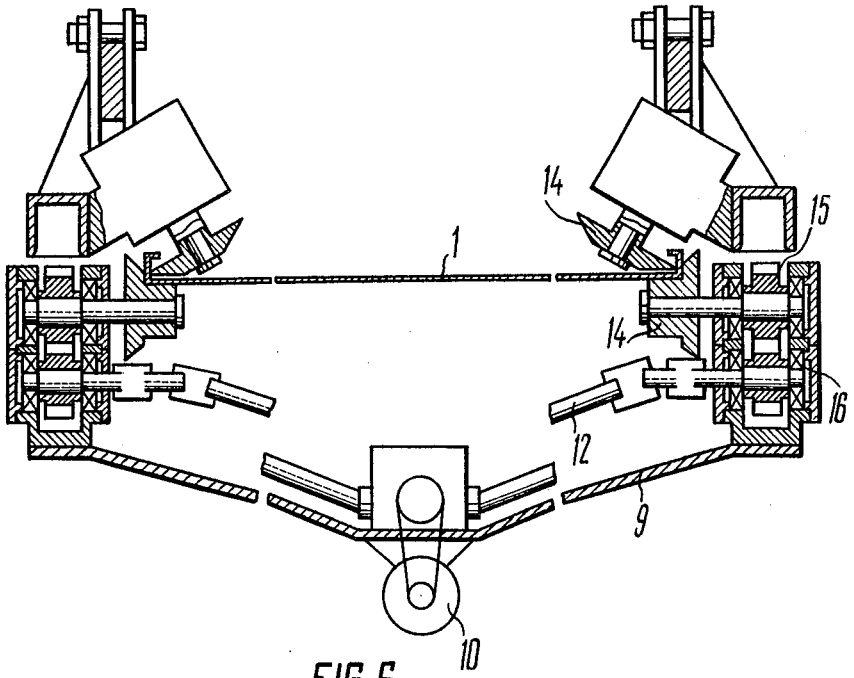
FIG. 6 is a general view of the bending mechanism.
Figure 7:
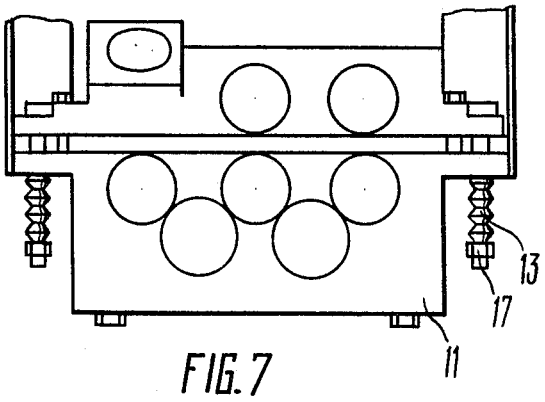
FIG. 7 is a side elevation of the bending head.
Figure 10:
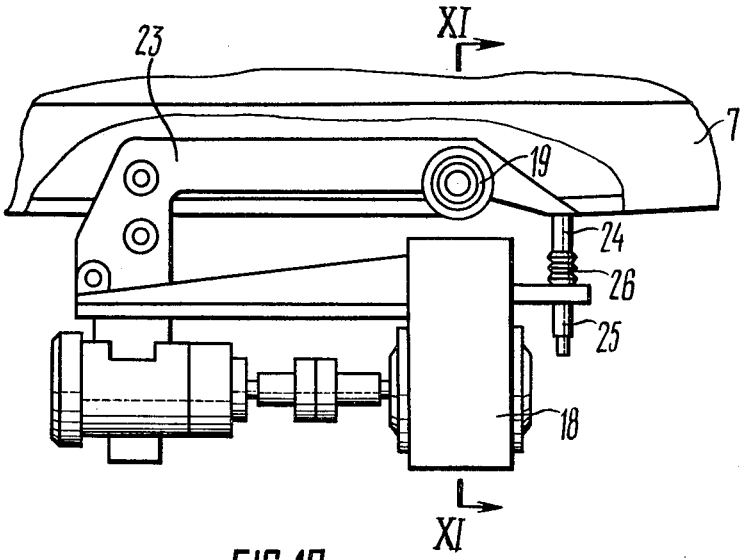
FIG. 10 is a general view of means for crimping the bent edges of ribbon.

The arrangement for effecting the method according to the invention comprises the bending mechanism 4 (FIG. 6) which is stationary mounted on two adjacent girders 7 within the installation opening of the building which is designed for performing the embedding of the ribbon ends and for being closed with panels afterwards, and means 8 for crimping the bent edges of the ribbon 1 (FIG. 10). The bending mechanism 4 comprises a ridig frame 9 having a drive 10 located in the central portion thereof which is of any appropriate construction. Bilaterally symmetrical bending heads 11 (FIG. 7) are mounted to the ends of the frame 9 and connected to the drive by means of a universal joint link 12. The bending head 11 consists of two parts which are made in the form of partially open bodies urged against each other by means of Belville springs 13 and accommodate profiled rollers 14 which are cantilevered on their shafts outside the bending head 11 and are directed toward the drive 10. The bending head 11 is provided with at least three pairs of the rollers 14 which are arranged in such a manner that the axes of two adjacent pairs of the rollers 14 extend in parallel with one another, and the axes of the third pair of rollers extend at an angle to each other. A gear 15 is fitted on each shaft within the bodies. Only one inclined roller is not connected to the drive.

All shafts are journalled in bearings 16.

In order to provide for accurate positioning of the bent edges of the ribbon relative to the board elements of the girders, the bending heads 11 are displaceable along the frame 9 and can be fixed by means of a bolt joint.

The urging force of the bending heads is adjusted by means of a nut 17 so that ribbons of different thickness may be used.

Means 8 for crimping the bent edges of the ribbon 1 (FIG. 10) comprises a housing having a crimping head 18 which accommodates a reducing gear connected to an electric motor by means of a clutch, and one pair of profiled rollers 19 mounted on either side of a gear 20 fitted on the central portion of a shaft 21 journalled in bearings 22.

A cross-piece 23 is mounted to the girder 7, and the cross-piece is connected to the housing with both ends thereof, one end of the cross-piece being articulated to the housing and the the other end, which is on the side of a second pair of the profiled rollers 19 mounted on the cross-piece 23, is connected to the housing by means of a clamping member 24.

The cross-piece 23 is mounted on two pairs of the profiled rollers 19 embracing the board elements 6 of the girders 7 which are journalled in bearings 22 on parallel axles. It is noted that one pair of the rollers 19 is designed as a movable support of the cross-piece 23.

Figure 11:
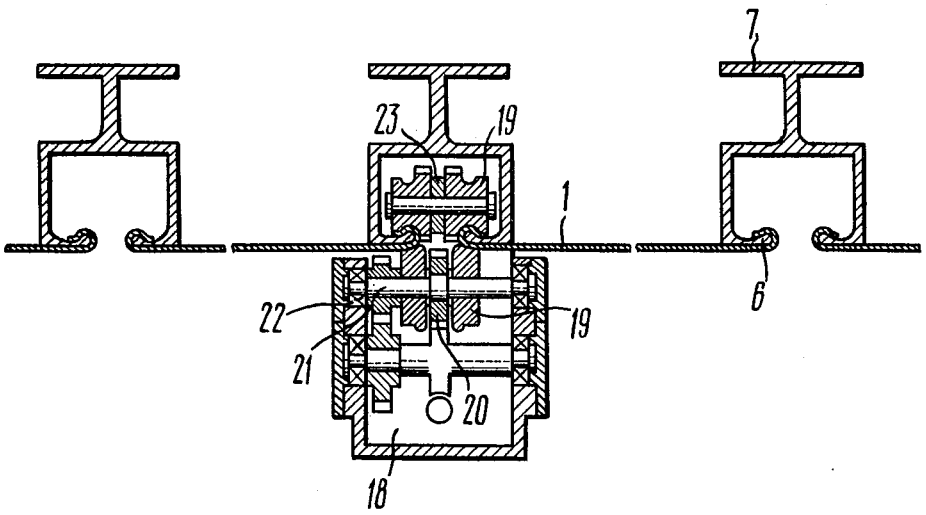
FIG. 11 is a sectional view taken along the line XI—XI in FIG. 10.

The second pair of the profiled rollers 19 is cantilevered in bearings 22 on an axis which is symmetrical relative to the cross-piece 23 and coaxially with and above the rollers 19 accommodated within the reducing gear in such a manner that these pairs of rollers define an outside profile corresponding to the shape of the board elements 6 of the girder 7 (FIG. 11). Large module teeth are cut on the outer surface of the rollers 19 mounted on the cross-piece 23, the teeth being adapted to mesh with the gear 20 of the reduction gear. The amount of gap and the compression force between the rollers 19 of the cross-piece 23 and rollers 19 accommodated within the redcing gears are adjusted by means of a nut 25, and the compression force is provided for by Belville springs 26.

The arrangement for installation of a suspended ribbon-type ceiling according to the invention functions in the following manner.

Figure 4:
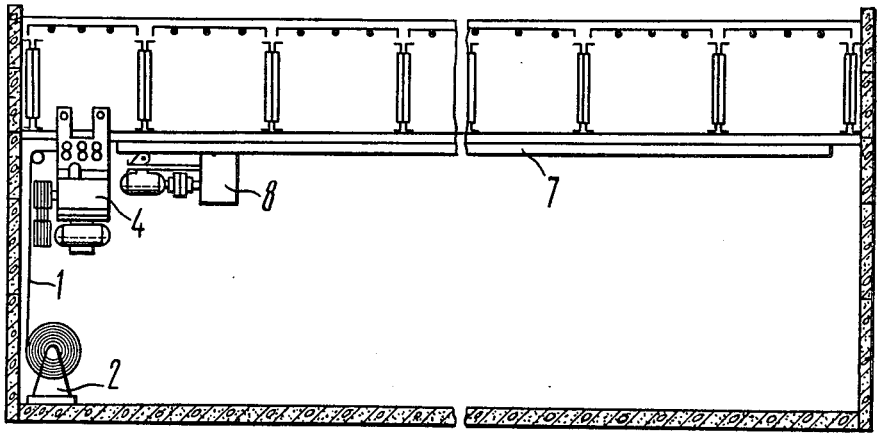
FIG. 4 is an arrangement for effecting the method according to the invention shown within the installation opening of a building shown in a longitudinal section.
Figure 5:
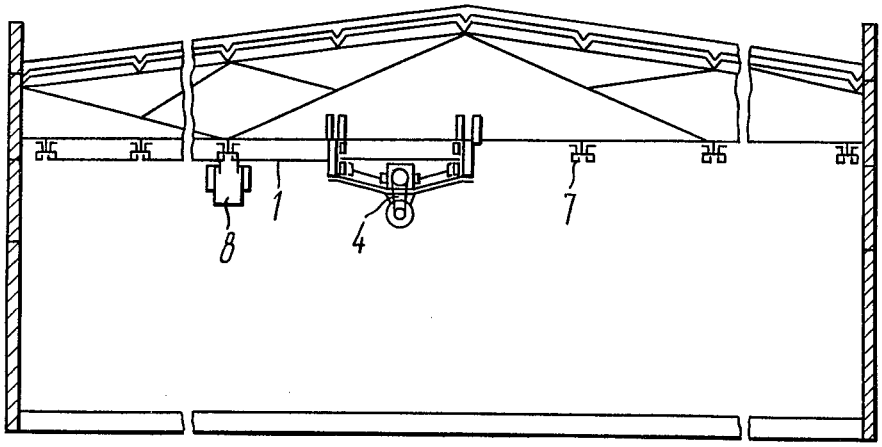
FIG. 5 is the same view as in FIG. 4, but the building is shown in a transverse section.

The coiled ribbon 1 of aluminum alloy is mounted in an uncoiling means 2 (FIGS. 4 and 5). A tensioning member 3 is secured to one end of the ribbon, and the ribbon is lifted with this member by means of a crane up to the altiture of the girders 7 to a point, where a guide shaft and the bending mechanism 4 suspended to two adjacent girders 7 by means of bolt joints facing the board elements 6 of the girders are preliminarily installed within the installation opening of the building.

Figure 8:
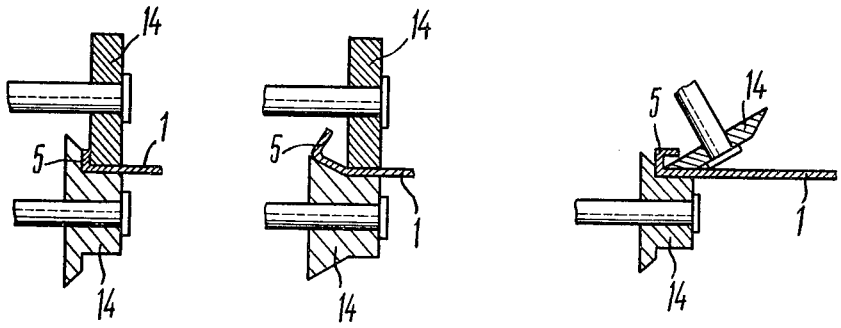
FIG. 8 illustrates the operation sequence of the driven rollers of the bending mechanism during the bending of longitudinal edges of the ribbon.
Figure 9:
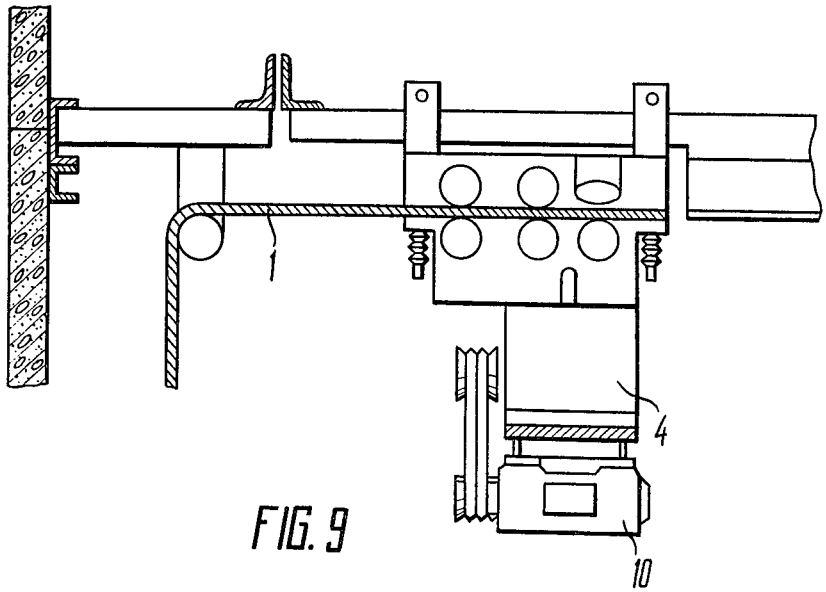
FIG. 9 shows the bending mechanism arranged within the installation opening of a building which is shown in a longitudinal section.

The lifted ribbon 1 is fed in guides of the bending mechanism 4 (FIG. 9) in which the longitudinal edges 5 of the ribbon 1 pass through nips of the rollers 14 driven by the drive 10 to be bent gradually at different angles (FIG. 8) toward the board elements 6 to obtain a profile corresponding to the shape of these elements. The ultimate pair of the rollers 14 of the bending mechanism 14 is positioned relative to the cross-section of the board elements in such a manner that the ribbon leaving the bending mechanism is immediately fitted with the bent edges thereof over the board elements 6 of the girders 7 and is thereby fixed to the latter.

The ribbon, which is thus fixed, is drawn by means of the crane along the entire length of the building. Then the ribbon is cut off for a required dimension, and another tensioning member 3 is secured to the ribbon end.

Then the bending mechanism and the guide shaft are removed and transferred into the next span of the building.

The free ends of the tensioning members are secured in special channel bars in the installation opening, and the ribbon is tensioned to achieve a stress $\sigma = 100–150$ kg/cm$^2$.

Prior to the installation of means 8 for crimping the bent edges 5 on the girder, the rollers 19 thereof are spaced apart at a distance which is by 1–2 mm greater than the size of the bent edges of the ribbon. Then the means 8 is lifted into the installation opening and placed with the spaced apart rollers 19 onto the bent edges of the ribbon which are already fitted to the board elements 6 of the girder 7, until the entire cross-piece 23 is received between the board elements of the girders. The rollers 19 are compressed by means of the nut 25, via the Belville springs 26, and the electric motor is energized to drive the rollers, via the clutch and reducing gear, thereby causing the movement of the crimping means 8 along the girder up to the opposite installation opening, the rollers crimping the bent edges 5 of the ribbon 1 (FIG. 11).

Then the means 8 is removed through the installation opening, and the tensioned ribbon remains fastened to the girder by means of the edges thereof crimped around the board elements of the girder. Then the above-described sequence of operations is repeated in the next spans of the building.

It will be apparent from the description that the method and arrangement for installation of ribbon-type enclosing structures provide an efficient facility for fastening the ribbon to the girders and enable high productivity of installation.

We claim

1. An arrangement for installation of ribbon-type enclosing structures comprising: a coiled ribbon with an uncoiling means; a bending mechanism for shaping the ribbon to obtain a profile corresponding to the shape of the board elements of girders, said mechanism having a rigid frame disposed beneath said ribbon drawn between two adjacent girders, and two bilaterally symmetrical bending heads mounted to both ends of said frame and rigidly connected to said girders; means for crimping the bent edges of the ribbon, said means comprising a housing having a crimping head and a cross-piece movably mounted to said girder and connected with both ends thereof to said housing, one end of said cross-piece being articulated to said housing, and a clamping member, the other end of said cross-piece being connected to said housing by means of said clamping member.

2. An arrangement according to claim 1, wherein said bending head comprises two spring-loaded parts accommodating at least three pairs of driven rollers, the axes of two adjacent pairs of the rollers extending in parallel with one another and the axes of the third pair extending at an angle to each other.

3. An arrangement according to claim 2, wherein the driven rollers of the bending head are profiled.

4. An arrangement according to claim 1, wherein the crimping head is provided with two pairs of driven rollers embracing the board elements of the girder, the axes of the rollers extending in parallel with one another.

5. An arrangement according to claim 4, wherein the driven rollers are spring-loaded and profiled.

* * * * *